US007874296B1

(12) United States Patent
Saidi

(10) Patent No.: US 7,874,296 B1
(45) Date of Patent: Jan. 25, 2011

(54) CIGARETTE GAS FILTER

(76) Inventor: Mohammad Said Saidi, 5232 Avery Green Dr., Glen Allen, VA (US) 23059

( * ) Notice: Subject to any disclaimer, the term of this patent is extended or adjusted under 35 U.S.C. 154(b) by 702 days.

(21) Appl. No.: 11/878,468

(22) Filed: Jul. 25, 2007

Related U.S. Application Data

(60) Provisional application No. 60/820,395, filed on Jul. 26, 2006.

(51) Int. Cl.
*A24D 3/04* (2006.01)

(52) U.S. Cl. ..... 131/339; 131/361

(58) Field of Classification Search ..... 131/339, 131/361
See application file for complete search history.

(56) References Cited

U.S. PATENT DOCUMENTS 3,336,928 A * 8/1967 Morehouse ..... 131/339
3,910,287 A * 10/1975 Walton ..... 131/336
4,135,523 A * 1/1979 Luke et al. ..... 131/336
4,492,240 A * 1/1985 Hayes et al. ..... 131/336
4,553,556 A * 11/1985 Lephardt ..... 131/336
4,583,560 A * 4/1986 Sakai et al. ..... 131/336
4,791,943 A * 12/1988 Kupper et al. ..... 131/339
5,178,166 A * 1/1993 Newsome et al. ..... 131/336
5,345,951 A * 9/1994 Serrano et al. ..... 131/194
5,568,819 A * 10/1996 Gentry et al. ..... 131/342
6,457,475 B1 * 10/2002 Tani et al. ..... 131/361
6,718,989 B1 * 4/2004 Clarke et al. ..... 131/339
7,552,735 B2 * 6/2009 Xue et al. ..... 131/339
2005/0076927 A1 * 4/2005 Schluter et al. ..... 131/339

* cited by examiner

*Primary Examiner*—Carlos Lopez

(57) ABSTRACT

Cigarette gas filter is used to filter the gaseous components of main stream smoke. This causes reduction of the delivery of the gaseous constituents of main stream smoke (MSS). The gas filter consists of a narrow annular gap, where the outer side is circumvented by a high permeability wrapper paper. As the cigarette smoke is passed through this annulus gap, the fraction of gases present in the smoke is reduced by diffusion mechanism and due to inflow of air into the annulus by convection mechanism. Since the diffusion coefficient of aerosol particles are several orders of magnitude smaller than the gas molecules, the aerosol particles are kept mainly intact while passing through the annulus. Therefore this filter is applied for reducing the gas/tar ratio. This filter can also be used to filter the gases of non-cigarette smokes.

18 Claims, 7 Drawing Sheets

Section A-A

Section B-B

Section B-B

Section A-A

Section B-B

Section B-B

Section A-A

Section B-B

Section B-B

CIGARETTE GAS FILTER

This application claims the benefit of Provisional Application Ser. No. 60/820,395, filed on Jul. 26, 2006, to which priority is claimed pursuant to 35 U.S.C. §119 (e) and which is hereby incorporated herein by reference.

BACKGROUND OF THE INVENTION

Previous efforts have been made to reduce the gas/tar ratio, especially the CO/tar ratio, of the MSS of cigarettes. Among the chemical methods one may refer to different catalysts added to the cigarette to enhance carbon monoxide to carbon dioxide conversion, and among the physical methods one may refer to carbon filters. Embodiments of the present invention comprise a gas filter in which neither chemical reactions, nor chemical or physical additives nor absorbents are necessarily involved. The design of the cigarette gas filter can be optimized to increase the cigarette gas filter's efficiency while keeping the cigarette gas filter's effect on increasing the gas flow pressure drop acceptable.

SUMMARY OF THE INVENTION

The cigarette gas filter of embodiments of the invention comprises a narrow annular gap, where the outer side of the gap is formed by a permeable paper. As the cigarette smoke is drawn through this annulus gap by the inhalation of the user, air is drawn into the annulus through the permeable paper to reduce the fraction of gases present in the smoke.

DETAILED DESCRIPTION OF THE INVENTION

Figure 1A:
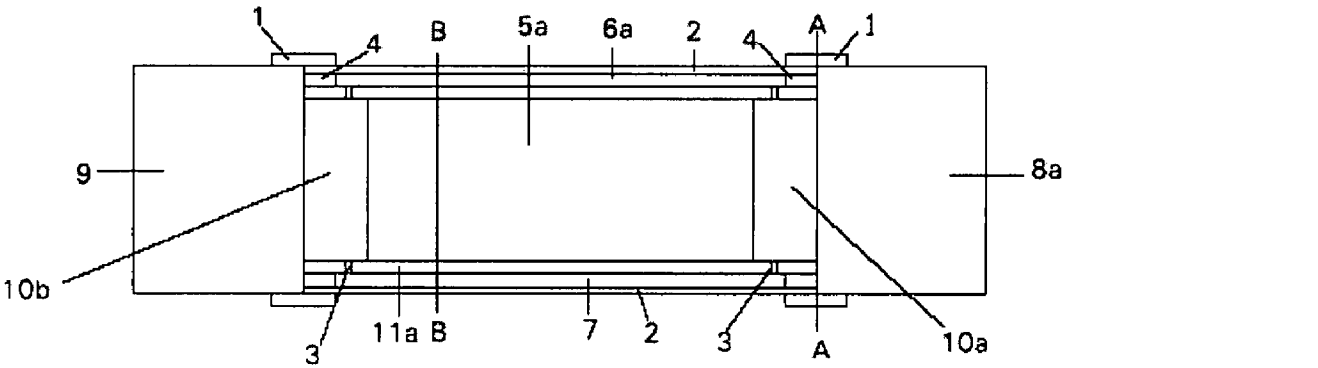
FIG. 1A illustrates a cross-sectional view along the longitudinal axis of a cigarette gas filter, in accordance with one embodiment of the present invention.
Figure 1B:
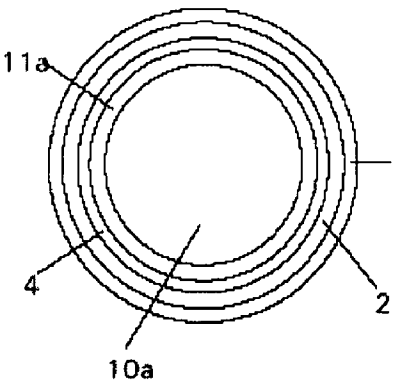
FIG. 1B illustrates a cross-sectional view of the cigarette gas filter of FIG. 1A along section A-A, in accordance with one embodiment of the present invention.
Figure 1C:
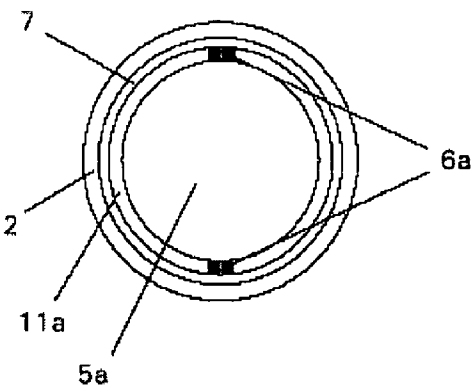
FIG. 1C illustrates a cross-sectional view of the cigarette gas filter of FIG. 1A along section B-B, in accordance with one embodiment of the present invention.
Figure 1D:
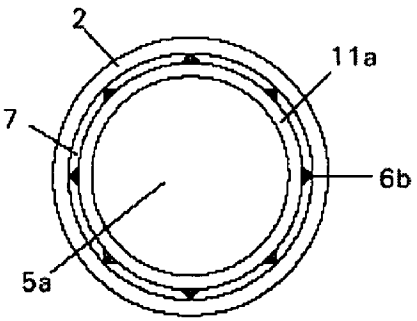
FIG. 1D illustrates a cross-sectional view of the cigarette gas filter of FIG. 1A along section B-B, in accordance with one embodiment of the present invention.

A cigarette gas filter of embodiments of the present invention is used to filter the gaseous components of main stream smoke of a cigarette, such as carbon monoxide. This causes a reduction of the delivery of the gaseous constituents of main stream smoke (MSS) to a user, while still allowing the aerosol particles (such as tar) to reach the user. The cigarette gas filter comprises a narrow annular gap, where the outer side of the gap is formed by a permeable paper. As the cigarette smoke is drawn through this annulus gap by the inhalation of the user, air is drawn into the annulus (and thus into the MSS) through the permeable paper by a convection mechanism. The fraction of gases present in the smoke may be reduced due to the drawing in of air and also by a diffusion mechanism. Since the diffusion coefficient of the aerosol particles is several orders of magnitude smaller than that of the gas molecules, the aerosol particles may be kept mainly intact while passing through the annulus. Therefore this cigarette gas filter is applied for reducing the gas/tar ratio.

The cigarette gas filter can be integrated with a cigarette to make a filtered cigarette. Also the cigarette gas filter can be made separately and then applied by the user to the cigarette/cigar during smoking.

The cigarette gas filter can be integrated with a cigarette in different arrangements as shown in FIGS. 1A-D, 2A-D, and 3A-D. The cigarette burning part (i.e., the tobacco column) may be attached to the cigarette gas filter of the present invention at the upstream side of the cigarette gas filter (i.e., the side opposite the user), as illustrated by elements 8*a* and 8*b* in FIGS. 1A and 2A, respectively, or the cigarette gas filter of the present invention may surround the tobacco column, as illustrated by element 8*c* in FIG. 3A. The materials used to make the cigarette gas filter may be either cellulose or other disposable materials. Different kinds of chemicals and additives can be mixed with the cellulose or disposable material to enhance its properties.

Figure 2A:
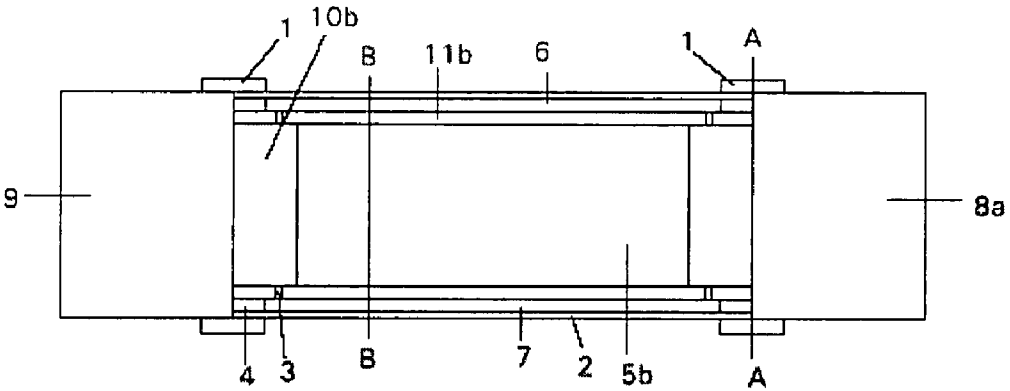
FIG. 2A illustrates a cross-sectional view along the longitudinal axis of a cigarette gas filter, in accordance with one embodiment of the present invention.
Figure 2B:
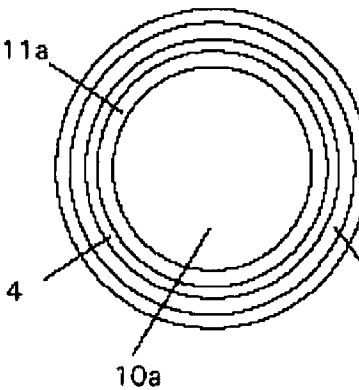
FIG. 2B illustrates a cross-sectional view of the cigarette gas filter of FIG. 2A along section A-A, in accordance with one embodiment of the present invention.
Figure 2C:
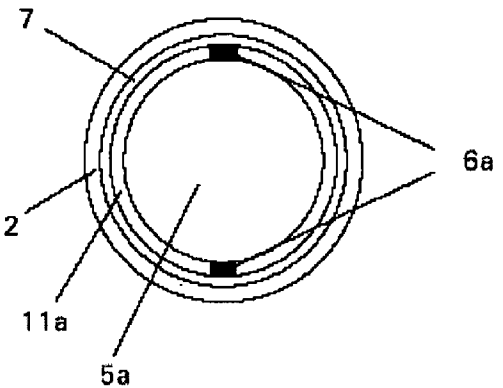
FIG. 2C illustrates a cross-sectional view of the cigarette gas filter of FIG. 2A along section B-B, in accordance with one embodiment of the present invention.
Figure 2D:
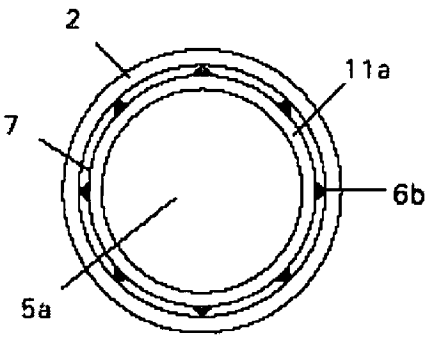
FIG. 2D illustrates a cross-sectional view of the cigarette gas filter of FIG. 2A along section B-B, in accordance with one embodiment of the present invention.
Figure 3A:
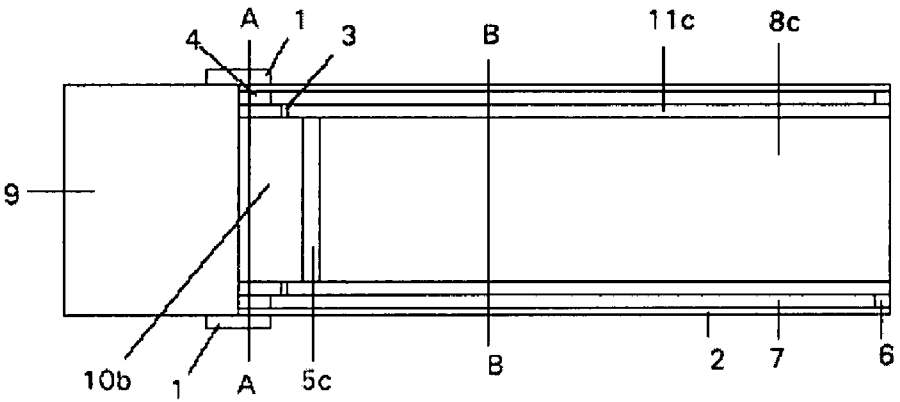
FIG. 3A illustrates a cross-sectional view along the longitudinal axis of a cigarette gas filter, in accordance with one embodiment of the present invention.
Figure 3B:
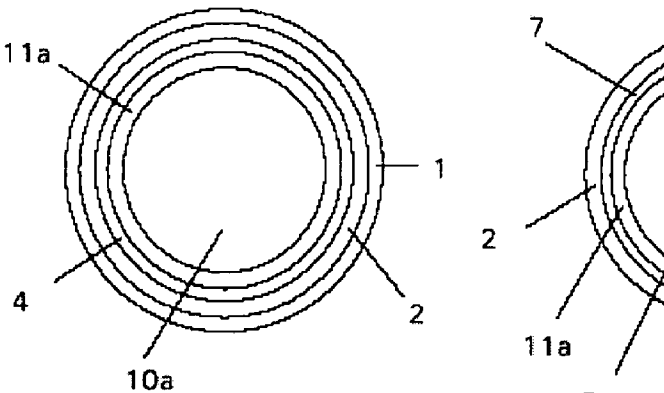
FIG. 3B illustrates a cross-sectional view of the cigarette gas filter of FIG. 3A along section A-A, in accordance with one embodiment of the present invention.
Figure 3C:
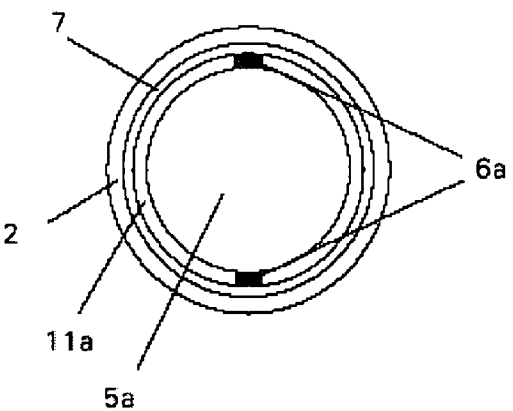
FIG. 3C illustrates a cross-sectional view of the cigarette gas filter of FIG. 3A along section B-B, in accordance with one embodiment of the present invention.
Figure 3D:
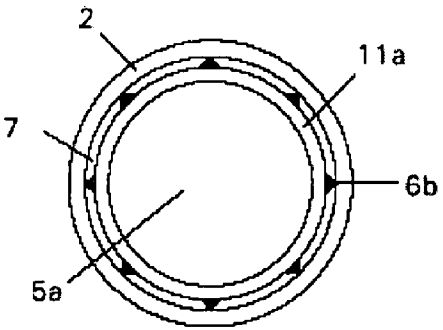
FIG. 3D illustrates a cross-sectional view of the cigarette gas filter of FIG. 3A along section B-B, in accordance with one embodiment of the present invention.

The common feature of the embodiments illustrated in FIGS. 1A, 2A, and 3A is the annulus air gap 7 in which the outer side of the gap is formed by a permeable paper 2. The permeability of the permeable paper 2 may be further increased by either partially or totally perforating the permeable paper 2.

The cigarette gas filter of the present invention, as illustrated in FIGS. 1A and 2A, may comprise filling block 5*a* or 5*b*, which in turn may comprise impermeable cellulose or other disposable materials. For FIG. 3A the filling block may be replaced by the inner section 8*c* which comprises cigarette tobacco cut filler. Additionally, the cigarette gas filter of FIG. 3A may comprise filling block 5*c*. The impermeable filling block forces the smoke to pass through the air gap 7, rather than directly from the tobacco column 8*c* to the downstream section 9, as described further below. For the case of FIGS. 1A and 2A, the filling block 5*a* or 5*b* may be wrapped by covering sheet 11*a* or 11*b*, respectively, which comprise an impermeable cellulosic material or other type of disposable material. For the case of FIG. 3A, the covering sheet 11*c* comprises a permeable sheet that may be perforated to increase its permeability. The covering sheet 11*c* may be made of cellulose or other type of disposable material.

The outer diameter of the cigarette gas filter is generally chosen to match the cigarette size. The air gap 7 thickness is typically in the range of between about 0.1 millimeter (mm) to 2.5 mm. The air gap 7 thickness affects both the cigarette gas filter efficiency and air flow pressure drop. In order to have a uniform air gap 7 thickness, a spacer of cellulosic material or other type of disposable material may be wrapped around the covering sheet 11*a*, 11*b* or 11*c*. The covering sheet 11*a* or 11*b* may be integrated with the filling block 5*a* or 5*b*, respectively, to form a single piece.

Figure 4:
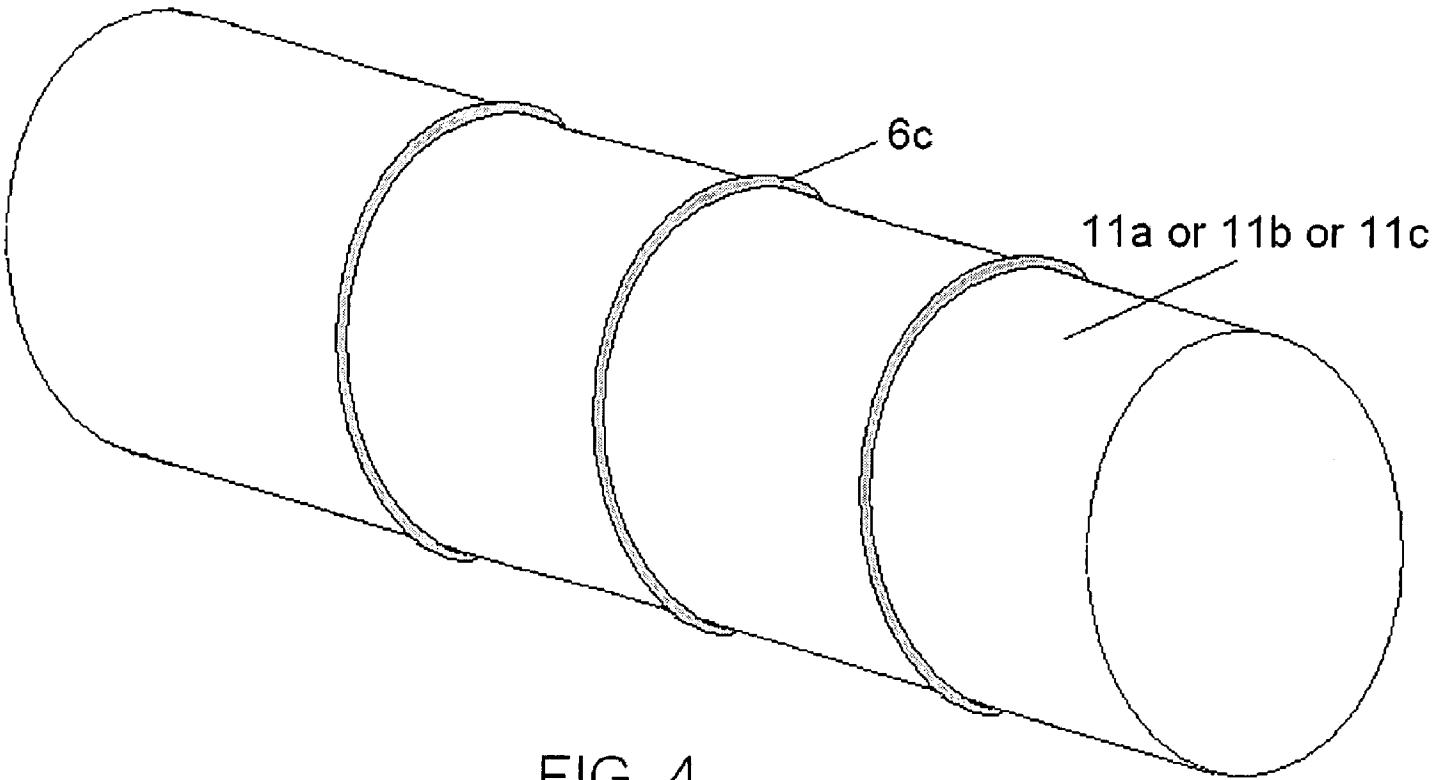
FIG. 4 illustrates a prospective view of an annulus spacer of a cigarette gas filter, in accordance with one embodiment of the present invention.

The spacer may comprise many different shapes. For example, the spacer may comprise a single thread wrapped around the covering sheet in a spiral coil, as illustrated by element 6*c* of FIG. 4. The spacer may comprise two or more linear ribs along the longitudinal axis on the surface of covering sheet 7, as illustrated by element 6*a* of FIGS. 1C, 2C and 3C. The spacer may comprise a plurality of corrugations spaced around the perimeter of the covering sheet, as illustrated by element 6*b* of FIGS. 1D, 2D and 3D. The spacer shapes described above are for illustrative purposes only. Many other shapes and configurations of the spacer are possible to be able to let the air pass through the air gap and are considered within the scope of the present invention. The spacer may be integrated with the covering sheet 11*a*, 11*b*, 11*c* to form a single piece. The spacer may be integrated with the permeable paper 2 to form a single piece. The air gap 7 thickness may be made uniform or non-uniform along the cigarette gas filter axis. For example, in the cigarette gas filter of FIG. 3A in which the tobacco column is within the cigarette gas filter, the air gap may be thinner at the downstream end and thicker at the upstream end, or vice versa.

The cigarette gas filter typically has one or two headers, which are air spaces at the upstream and/or downstream ends of the cigarette gas filter. The upstream header 10*a* (see FIG. 1A) functions to allow the smoke to flow into the air gap 7, while the downstream header 10*b* (see FIGS. 1A, 2A, 3A) functions to allow the smoke to flow out of the air gap 7. Each header may be connected to the air gap 7 via the header holes 3 made on the covering sheets 11*a*, 11*b* or 11*c*. The cigarette gas filter of the present invention will typically comprise either one header (see FIGS. 2, 3) or two headers (see FIG. 1). The size, orientation, and number of header holes 3 may vary and are generally determined based on required pressure drop and the air flow. Optionally, the cigarette gas filter of the present invention may comprise one or more elongated header slits rather than header holes.

At the upstream end, the cigarette gas filter may be connected to the tobacco column in such a fashion that the smoke enters the air gap directly from the tobacco column (see FIG. 2) In one alternative embodiment, the cigarette gas filter may be connected to the tobacco column in such a fashion that the smoke enters the air gap 7 by passing through the upstream header 10*a* and then through the upstream header holes 3 (see FIG. 1). In another alternative embodiment, the cigarette gas filter surrounds the tobacco column such that the smoke enters the air gap 7 by passing through the covering sheet 11*c* (see FIG. 3). An impermeable sheet 4 may be placed around the covering sheet 11*a*, 11*b* or 11*c* to direct the flow of smoke in the desired path. This impermeable sheet may be physically distinct from the annulus spacer 6*a*, 6*b* or 6*c*, or the impermeable sheet may be integral with the annulus spacer. The cigarette gas filter of embodiments of the invention is typically attached at the downstream side to the downstream section 9 which enables a user to hold the cigarette (with the cigarette gas filter) in the user's mouth. The downstream section 9 may comprise a mouth piece which merely directs the smoke from the cigarette gas filter into the user's mouth. Or the downstream section 9 may comprise an additional, different type of filter to provide additional filtering of the smoke.

Figure 5:
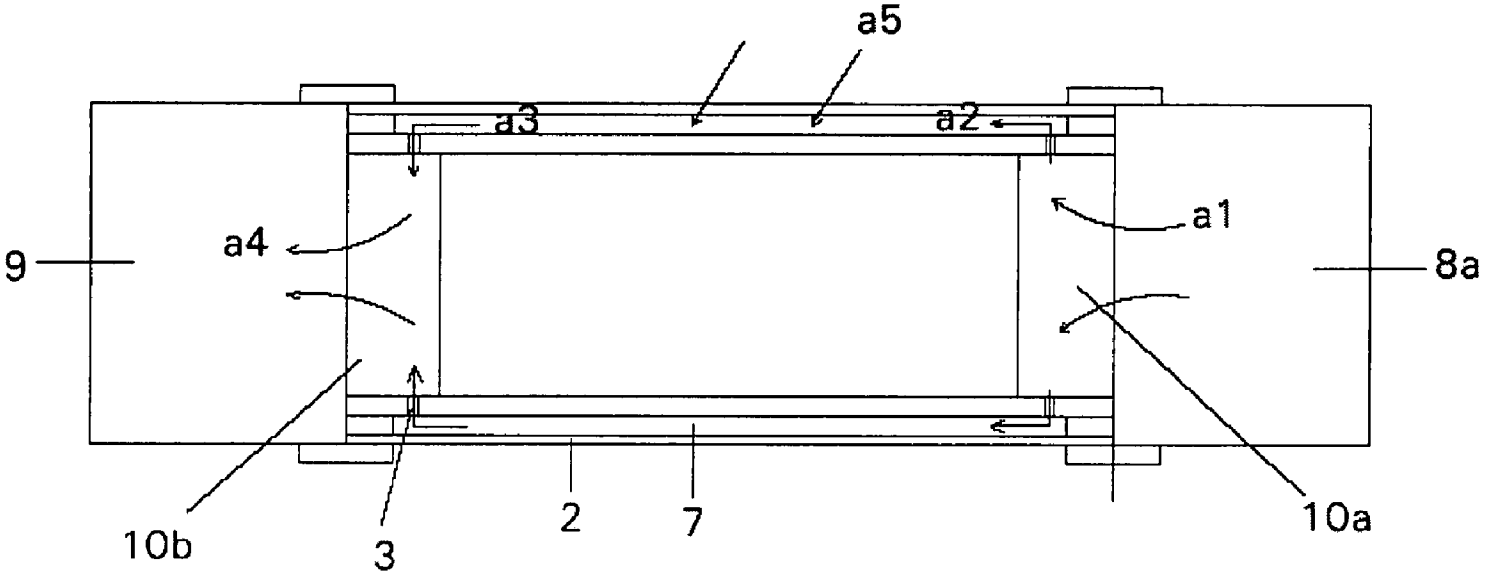
FIG. 5 illustrates a cross-sectional view along the longitudinal axis of the cigarette gas filter of FIG. 1, illustrating the flow of smoke and air through the cigarette gas filter.
Figure 6:
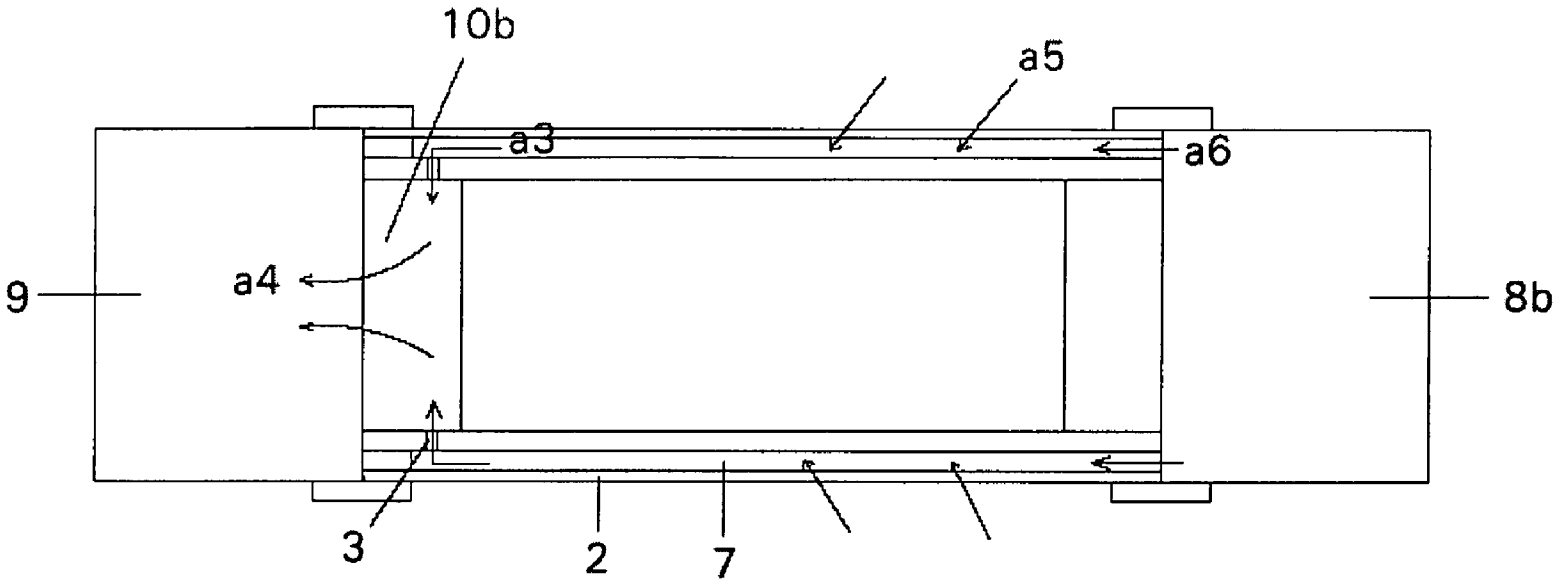
FIG. 6 illustrates a cross-sectional view along the longitudinal axis of the cigarette gas filter of FIG. 2, illustrating the flow of smoke and air through the cigarette gas filter.
Figure 7:
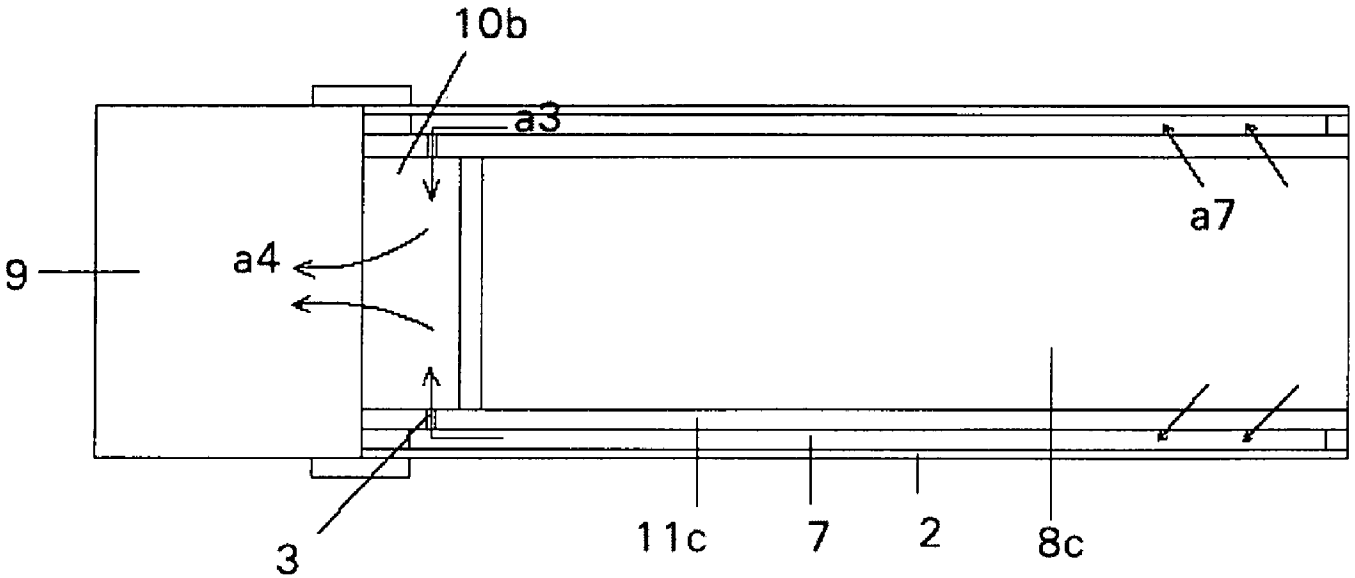
FIG. 7 illustrates a cross-sectional view along the longitudinal axis of the cigarette gas filter of FIG. 3, illustrating the flow of smoke and air through the cigarette gas filter.

The flow of smoke through the cigarette gas filter is illustrated in FIGS. 5, 6, and 7. FIG. 5 illustrates the flow of smoke through the cigarette gas filter of FIG. 1A. FIG. 5 illustrates that the smoke generated in the upstream section 8*a* flows into upstream header 10*a* as shown by arrows a1, passes through the header holes 3 as shown by arrows a2, is collected into the downstream header 10*b* by passing through the header holes 3 as shown by arrows a3, and finally flows from the downstream header 10*b* into the downstream section 9 as shown by arrows a4. The flow of smoke through the cigarette gas filter is caused by inducing suction (via the user's mouth) at the downstream section 9. Since this suction induces a negative relative pressure inside the air gap 7, the ambient air is drawn into the air gap 7 by passing through the paper 2 as shown by arrows a5. As described above, this drawn-in air reduces the fraction of gases present in the smoke by a convection mechanism, thereby reducing the gas/tar ratio of the smoke reaching the user.

FIG. 6 illustrates the flow of smoke through the cigarette gas filter of FIG. 2A. In this embodiment, the smoke flow is similar to FIG. 5 except that here the smoke generated in the upstream section flows into the air gap 7 directly as shown by arrows a6. FIG. 7 illustrates the flow of smoke through the cigarette gas filter of FIG. 3A. In this embodiment, the smoke generated in section 8*c* flows from the tobacco column 8*c* through the covering sheet 11*c* and into the air gap 7 as shown by arrows a7.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

What is claimed is:

1. A cigarette gas filter comprising: a cylindrical inner piece, a cylindrical outer piece, and a spacer, wherein the said cylindrical inner piece and the said cylindrical outer piece are concentric cylindrical pieces put together by the said spacer to form a narrow annular air gap, wherein the said cylindrical outer piece comprises a permeable paper, and the said cigarette gas filter is adapted with a cigarette, so that once the cigarette is smoked by a user; it makes the mainstream smoke to pass through the said narrow annular gap, wherein the smoke is drawn through the said narrow annular gap by the inhalation of the user, wherein air is drawn into the said narrow annular gap through the permeable paper to reduce the fraction of gases present in the smoke; wherein the said permeable paper comprises cellulose or other disposable materials: wherein the said permeable paper further comprising chemicals and additives: wherein the said permeable paper is partially or totally perforated: wherein the said cigarette comprises a burning part, wherein the said cigarette gas fitter surrounds the said burning part of a cigarette to make a filtered cigarette.

2. The cigarette gas filter of claim 1; wherein the said cigarette gas filter is applied to a cigarette/cigar as a separate filter.

3. The cigarette gas filter of claim 1; wherein the said spacer comprises cellulose or other disposable materials.

4. The cigarette gas filter of claim 1; wherein the said cigarette gas filter is attached to the said burning part of a cigarette.

5. The cigarette gas filter of claim 4, further comprising an outer diameter wherein the said outer diameter is the same as the burning part of a cigarette diameter.

6. The cigarette gas filter of claim 5, wherein the said cigarette gas filter and the said attached cigarette burning part make a combined filtered cigarette.

7. The cigarette gas filter of claim 6, wherein the said cylindrical inner piece comprises impermeable cellulose or other disposable materials.

8. The cigarette gas filter of claim 3, wherein the said cylindrical inner piece is replaced with the said cigarette burning part.

9. The cigarette gas filter of claim 8, wherein the said cigarette burning part comprising a perforated permeable paper.

10. The cigarette gas filter of claim 1, wherein the said narrow annular air gap thickness is in the range of 0.1 mm (millimeter) to 23 mm.

11. The cigarette gas filter of claim 10, wherein the said narrow annular air gap thickness is either uniform/nonuniform.

12. The cigarette gas filter of claim 1, wherein the said spacer is wrapped around the said cylindrical inner piece.

13. The cigarette gas filter of claim 12, wherein the said spacer comprising a thread wrapped around the said cylindrical inner piece as a spiral coil.

14. The cigarette gas filter of claim 12, wherein the said spacer comprising two or more linear ribs along the longitudinal axis on the surface of said cylindrical inner piece.

15. The cigarette gas filter of claim 12, wherein the said spacer comprising a plurality of corrugations placed around the said cylindrical inner piece.

16. The cigarette gas filter of claim 1, wherein the said spacer is integrated with the said cylindrical inner and or said cylindrical outer piece.

17. The cigarette gas filter of claim 4, wherein the said cigarette gas filter comprising one or two headers, comprising air spaces at the upstream and/or downstream ends of the said cigarette gas filter to allow the smoke to flow into/out of the said narrow annular air gap.

18. The cigarette gas filter of claim 17, wherein each of the said headers further comprising holes/slits and are connected to the said narrow annular air gap of said cigarette gas filter via the said header holes/slits made on the said cylindrical inner piece.

* * * * *